US011332805B2

(12) United States Patent
Natsumeda et al.

(10) Patent No.: US 11,332,805 B2
(45) Date of Patent: May 17, 2022

(54) HIGH-STRENGTH STEEL SHEET AND PRODUCTION METHOD FOR SAME

(71) Applicant: Kabushiki Kaisha Kobe Seiko Sho (Kobe Steel, Ltd.), Kobe (JP)

(72) Inventors: Hirokazu Natsumeda, Kobe (JP); Toshio Murakami, Kobe (JP); Kenji Saito, Kakogawa (JP); Tadao Murata, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 82 days.

(21) Appl. No.: 16/615,462

(22) PCT Filed: May 14, 2018

(86) PCT No.: PCT/JP2018/018489
§ 371 (c)(1),
(2) Date: Nov. 21, 2019

(87) PCT Pub. No.: WO2018/216522
PCT Pub. Date: Nov. 29, 2018

(65) Prior Publication Data

US 2020/0071787 A1 Mar. 5, 2020

(30) Foreign Application Priority Data

May 24, 2017 (JP) ..... JP2017-103024

(51) Int. Cl.
*C22C 38/02* (2006.01)
*C21D 9/48* (2006.01)
(Continued)

(52) U.S. Cl.
CPC ..... *C21D 9/48* (2013.01); *C21D 8/0263* (2013.01); *C22C 38/02* (2013.01); *C22C 38/06* (2013.01);
(Continued)

(58) Field of Classification Search
None
See application file for complete search history.

(56) References Cited

U.S. PATENT DOCUMENTS

2004/0226635 A1* 11/2004 Ikeda ..... C22C 38/06 148/649
2011/0139315 A1 6/2011 Nakagaito et al.
(Continued)

FOREIGN PATENT DOCUMENTS

JP 2009-203548 A 9/2009
JP 2015-218365 A 12/2015
(Continued)

OTHER PUBLICATIONS

International Preliminary Report on Patentability dated Dec. 5, 2019 in PCT/JP2018/018489 filed May 14, 2018 (with English translation), 12 pages.
(Continued)

*Primary Examiner* — Seth Dumbris
(74) *Attorney, Agent, or Firm* — Oblon, McClelland, Maier & Neustadt, L.L.P.

(57) ABSTRACT

Disclosed is a high-strength sheet containing: C: 0.15% by mass to 0.35% by mass, a total of Si and Al: 0.5% by mass to 3.0% by mass, Mn: 1.0% by mass to 4.0% by mass, P: 0.05% by mass or less (including 0% by mass), S: 0.01% by mass or less (including 0% by mass), and Ti: 0.01% by mass to 0.2% by mass, with the balance being Fe and inevitable impurities, wherein the steel structure satisfies that: a ferrite fraction is 5% or less, a total fraction of tempered martensite and tempered bainite is 60% or more, a retained austenite fraction is 10% or more, a fresh martensite fraction is 5% or less, retained austenite has an average grain size of 0.5 μm or less, retained austenite having a grain size of 1.0 μm or more accounts for 2% or more of the total amount of
(Continued)

retained austenite, and a prior austenite grain size is 10 μm or less.

20 Claims, 1 Drawing Sheet

(51) Int. Cl.

| | |
|---|---|
| ***C21D 8/02*** | (2006.01) |
| ***C22C 38/06*** | (2006.01) |
| ***C22C 38/14*** | (2006.01) |
| ***C22C 38/58*** | (2006.01) |

(52) U.S. Cl.
CPC ..... *C22C 38/14* (2013.01); *C22C 38/58* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 2012/0305144 | A1 | 12/2012 | Okamoto et al. | |
| 2014/0044585 | A1* | 2/2014 | Naitou ..... | B21D 22/208 420/90 |
| 2014/0182748 | A1 | 7/2014 | Nakagaito et al. | |
| 2016/0369369 | A1 | 12/2016 | Takashima et al. | |
| 2017/0107591 | A1 | 4/2017 | Takashima et al. | |
| 2017/0268077 | A1* | 9/2017 | Murakami ..... | C21D 9/46 |
| 2019/0003009 | A1 | 1/2019 | Kawata et al. | |

FOREIGN PATENT DOCUMENTS

| | | | |
|---|---|---|---|
| JP | 2015-224359 | A | 12/2015 |
| JP | 2017-214648 | A | 12/2017 |
| KR | 10-2012-0107003 | A | 9/2012 |
| WO | WO 2017/164346 | A1 | 9/2017 |

OTHER PUBLICATIONS

Extended European Search Report dated Nov. 3, 2020 in corresponding European Patent Application No. 18806482.8, 13 pages.
International Search Report dated Jul. 31, 2018 in PCT/JP2018/018489 filed on May 14, 2018, 2 pages.

* cited by examiner

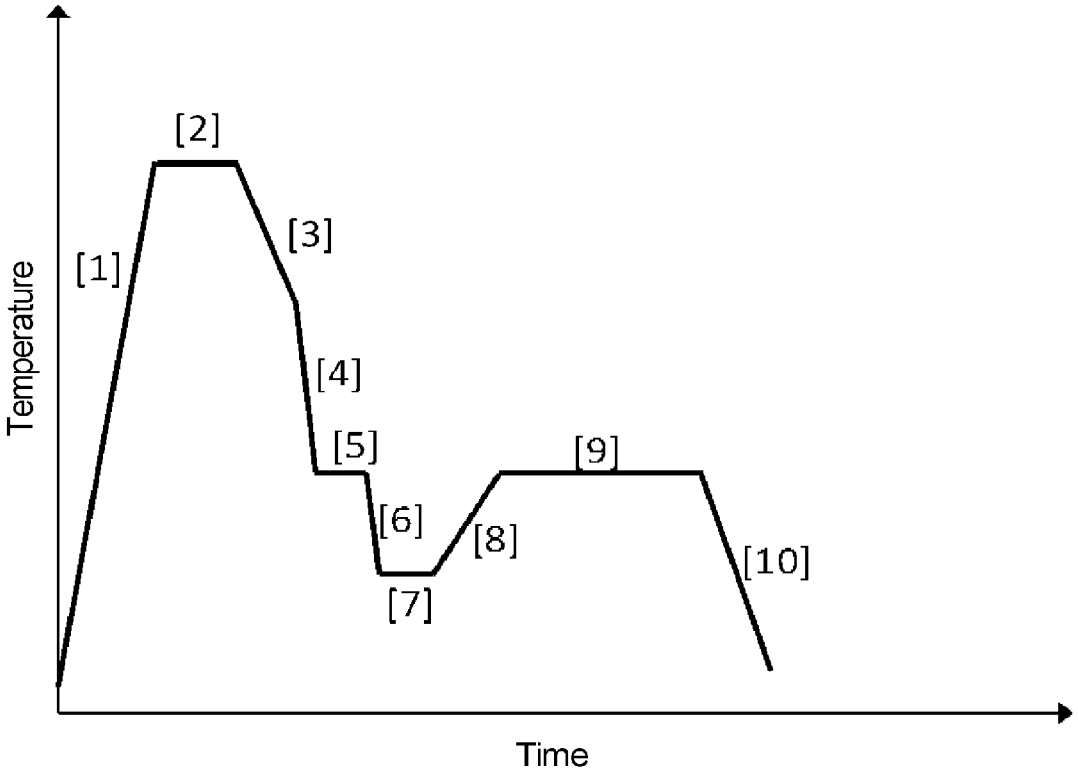
[1]
[2]
[3]
[4]
[5]
[6]
[7]
[8]
[9]
[10]
Temperature
Time

HIGH-STRENGTH STEEL SHEET AND PRODUCTION METHOD FOR SAME

TECHNICAL FIELD

The present disclosure relates to a high-strength sheet that can be used in various applications including automobile parts.

BACKGROUND ART

In recent years, steel sheets applied to automobile parts and the like have been required to undergo thinning in order to realize an improvement in fuel efficiency, and the steel sheets have been required to have higher strength in order to ensure the parts strength while thinning the steel sheets. Patent Document 1 discloses a high-strength sheet that has a tensile strength of 980 MPa to 1,180 MPa and exhibits a good deep drawing property.

PRIOR ART DOCUMENT

Patent Document

Patent Document 1: JP 2009-203548 A

SUMMARY OF THE INVENTION

Problems to be Solved by the Invention

However, when employing high-strength steel sheets including automobile parts, there is a concern about the low-temperature toughness of the steel sheets. Steel has been known to undergo brittle fracture, leading to significant decrease in impact value in a low-temperature environment below room temperature. Frame parts to which application of a high-strength steel sheet is envisioned are required to absorb energy during collision due to large deformation of the parts. In cold districts and the like where the steel sheet undergoes embrittlement, if the parts collide in an embrittled state in the actual use environment, a serious accident may occur. Therefore, in practical use, there is required a steel sheet that has not only high tensile strength (TS) and excellent deep drawability (LDR), as steel sheet properties, but also excellent strength-ductility balance and high hole expansion ratio (X) to ensure the formability during parts forming, and has high yield ratio (YR) from the viewpoint of ensuring collision safety, and also has excellent low-temperature toughness.

Specifically, there is required a steel sheet in which a tensile strength (TS) in a tensile test is 980 MPa or more, a product (TS×EL) of the tensile strength (TS) and a total elongation (EL) is 20,000 MPa % or more, a yield ratio (YR) is 0.75 or more, a hole expansion ratio (λ) is 20% or more, deep drawability (LDR) is 2.00 or more, cross tensile strength of a spot welded portion is 6 kN or more, and a Charpy impact value at −40° C. is 60 J/cm$^2$ or more.

However, it is difficult for the high-strength sheet disclosed in Patent Document 1 to satisfy all of these requirements, and there has been required a high-strength steel sheet that can satisfy all of these requirements.

The embodiments of the present invention have been made to respond to these requirements, and it is an object thereof to provide a high-strength sheet in which all of the tensile strength (TS), the cross tensile strength of the spot welded portion (SW cross tension), the yield ratio (YR), the product (TS×EL) of the tensile strength (TS) and the total elongation (EL), the deep drawability (LDR), the hole expansion ratio (λ), and the low-temperature toughness are at a high level, and a manufacturing method thereof.

Means for Solving the Problems

Aspect 1 of the present invention provides a high-strength sheet containing:

C: 0.15% by mass to 0.35% by mass, a total of Si and Al: 0.5% by mass to 3.0% by mass, Mn: 1.0% by mass to 4.0% by mass, P: 0.05% by mass or less (including 0% by mass), S: 0.01% by mass or less (including 0% by mass), and Ti: 0.01% by mass to 0.2% by mass, with the balance being Fe and inevitable impurities, wherein the steel structure satisfies that:

a ferrite fraction is 5% or less, a total fraction of tempered martensite and tempered bainite is 60% or more, a retained austenite fraction is 10% or more, a fresh martensite fraction is 5% or less, retained austenite has an average grain size of 0.5 μm or less, retained austenite having a grain size of 1.0 μm or more accounts for 2% or more of the total amount of retained austenite, and a prior austenite grain size is 10 μm or less.

Aspect 2 of the present invention provides the high-strength sheet according to aspect 1, in which the C amount is 0.30% by mass or less.

Aspect 3 of the present invention provides the high-strength sheet according to aspect 1 or 2, in which the Al amount is less than 0.10% by mass.

Aspect 4 of the present invention provides the high-strength sheet according to any one of aspects 1 to 3, which further contains one or more of Cu, Ni, Mo, Cr and B, and a total content of Cu, Ni, Mo, Cr and B is 1.0% by mass or less.

Aspect 5 of the present invention provides the high-strength sheet according to any one of aspects 1 to 4, which further contains one or more of V, Nb, Mo, Zr and Hf, and a total content of V, Nb, Mo, Zr and Hf is 0.2% by mass or less.

Aspect 6 of the present invention provides the high-strength sheet according to any one of aspects 1 to 5, which further contains one or more of Ca, Mg and REM, and a total content of Ca, Mg and REM is 0.01% by mass or less.

Aspect 7 of the present invention provides a method for manufacturing a high-strength sheet, which includes:

preparing a rolled material containing: C: 0.15% by mass to 0.35% by mass, total of Si and Al: 0.5% by mass to 3.0% by mass, Mn: 1.0% by mass to 4.0% by mass, P: 0.05% by mass or less (including 0% by mass), S: 0.01% by mass or less (including 0% by mass), and Ti: 0.01% by mass to 0.2% by mass, with the balance being Fe and inevitable impurities;

heating the rolled material to a temperature of an $Ac_3$ point or higher and an $Ac_3$ point+100° C. or lower to austenitize the material;

after the austenitization, cooling the material between 650° C. and 500° C. at an average cooling rate of 15° C./sec or more and less than 200° C./sec, and then retaining at a temperature in a range of 300° C. to 500° C. at a cooling rate of 10° C./sec or less for 10 seconds or more and less than 300 seconds;

after the retention, cooling the material from a temperature of 300° C. or higher to a cooling stopping temperature between 100° C. or higher and lower than 300° C. at an average cooling rate of 10° C./sec or more; and heating the material from the cooling stopping temperature to a reheating temperature in a range of 300° C. to 500° C.

Aspect 8 of the present invention provides the high-strength sheet according to aspect 7, in which the retention includes holding at a constant temperature in a range of 300° C. to 500° C.

Effects of the Invention

According to the embodiments of the present invention, it is possible to provide a high-strength sheet in which all of the tensile strength (TS), the cross tensile strength of the spot welded portion (SW cross tension), the yield ratio (YR), the product (TS×EL) of the tensile strength (TS) and the total elongation (EL), the deep drawability (LDR), the hole expansion ratio (λ), and the low-temperature toughness are at a high level, and a manufacturing method thereof.

BRIEF DESCRIPTION OF THE DRAWINGS

FIG. 1 is a diagram explaining a method for manufacturing a high-strength sheet according to the embodiment of the present invention, especially a heat treatment.

MODE FOR CARRYING OUT THE INVENTION

The inventors of the present application have intensively studied and found that it is possible to obtain a high-strength sheet in which all of the tensile strength (TS), the cross tensile strength of a spot welded portion (SW cross tension), the yield ratio (YR), the product (TS×EL) of the tensile strength (TS) and the total elongation (EL), the low-temperature toughness (impact value at low temperature), the deep drawability (LDR) and the hole expansion ratio (λ) are at a high level by allowing the steel structure (metal structure) to satisfy that: a ferrite fraction is 5% or less, a total fraction of tempered martensite and tempered bainite is 60% or more, a retained austenite fraction is 10% or more, a fresh martensite fraction is 5% or less, retained austenite has an average grain size of 0.5 μm or less, retained austenite having a grain size of 1.0 μm or more accounts for 2% or more of the total amount of retained austenite, and a prior austenite grain size is 10 μm or less, in a steel containing predetermined components.

1. Steel Structure

The steel structure of the high-strength sheet according to the embodiments of the present invention will be described in detail below.

In the following description of the steel structure, there are cases where mechanisms capable of improving various properties by having such the structure are described. It should be noted that these mechanisms are those envisaged by the inventors of the present application based on the findings currently obtained, but do not limit the technical scope of the present invention.

(1) Ferrite Fraction: 5% or Less

Ferrite generally has excellent workability but has a problem of low strength. A large amount of ferrite leads to degradation of hole expansion property (stretch flangeability). Therefore, the ferrite fraction is set at 5% or less (5 volume % or less). Furthermore, by setting the ferrite fraction at 5% or less, excellent hole expansion ratio λ can be obtained. In addition, by setting the ferrite fraction at 5% or less, high yield ratio can be obtained.

The ferrite fraction is preferably 3% or less, and more preferably 0%.

The ferrite fraction can be determined by observing with an optical microscope and measuring white region by the point counting method. By this method, it is possible to determine the ferrite fraction by an area ratio (area %). The value obtained by the area ratio may be directly used as a value of a volume ratio (volume %).

(2) Total Fraction of Tempered Martensite and Tempered Bainite: 60% or More

By setting the total fraction of tempered martensite and tempered bainite at 60% or more (60 volume % or more), it is possible to achieve both high strength and high hole expansion property. The total fraction of tempered martensite and tempered bainite is preferably 70% or more.

It is possible to determine the amounts (total fraction) of tempered martensite and tempered bainite by performing SEM observation of a Nital-etched cross-section, measuring a fraction of MA (i.e., a total of retained austenite and fresh martensite) and subtracting the above-mentioned ferrite fraction and MA fraction from the entire steel structure.

(3) Amount of Retained Austenite: 10% or More

The retained austenite causes the TRIP phenomenon of being transformed into martensite due to strain induced transformation during working such as press working, thus making it possible to obtain large elongation. Furthermore, martensite thus formed has high hardness. Therefore, excellent strength-ductility balance can be obtained. By setting the amount of retained austenite at 10% or more (10 volume % or more), it is possible to realize TS×EL of 20,000 MPa % or more and excellent strength-ductility balance.

The amount of retained austenite is preferably 15% or more.

It is possible to determine the amount of retained austenite by obtaining a diffraction intensity ratio of ferrite (including bainite, tempered bainite, tempered martensite and untempered martensite in X-ray diffraction) and austenite by X-ray diffraction, followed by calculation. As an X-ray source, Co—Kα ray can be used.

(4) Fresh Martensite Fraction: 5% or Less

Fresh martensite is a hard phase and vicinity of a matrix/hard phase interface acts as a void forming site during deformation. The more the fresh martensite fraction increases, the more strain concentration occurs at the matrix/hard phase interface, thus easily causing fracture from voids formed in the vicinity of the matrix/hard phase interface as a starting point.

Therefore, it is possible to improve the hole expansion ratio and the impact value (toughness) by setting the fresh martensite fraction at 5% or less, and suppressing fracture occurring at the matrix/hard phase interface as a starting point. The fresh martensite fraction is preferably 2% or less.

The fresh martensite fraction was defined as a region with a large crystal orientation difference by KAM (Kernel Average Misorientation) analysis in EBSD (Electron Back Scatter Diffraction Patterns) measurement. In KAM analysis, orientation differences between one pixel in a measurement point and six pixels adjacent to the one pixel are averaged to obtain the value of a center pixel, and a map based on the local crystal orientation difference can be created.

Regarding conditions for KAM analysis, data in which an index (CI (confidention index) value) indicating crystal orientation reliability is 0.1 or less and thus remarkably low were excluded from EBSD measurement data, and a maximum orientation difference between adjacent pixels in KAM analysis was set at 5°. Fresh martensite has high-density dislocations, and is therefore considered to correspond to a region having a large crystal orientation difference. That is, a region where an average of the crystal orientation differences in KAM analysis is 4.0° or more may be defined as fresh martensite, and an area ratio (area %) thereof may be defined as a volume ratio of fresh martensite.

(5) Prior Austenite Grain Size: 10 μm or Less

By making the prior austenite grain size finer, a fracture surface unit (facet size) leading to fracture can be made finer, thus enabling an improvement in the impact value. For this reason, the impact value can be improved by setting the prior austenite grain size at 10 μm or less.

It is possible to determine the prior austenite grain size by allowing the prior austenite grain boundary to appear due to picric acid etching, drawing a straight line in arbitrary position in a micrograph from optical microscope observation, measuring a length of intercept where the straight line crosses the prior austenite grain boundary, and calculating the average of the intercept lengths.

(6) Average Grain Size (Average Size) of Retained Austenite: 0.5 μm or Less, and Retained Austenite Having Grain Size (Size) of 1.0 μm or More: Accounting for 2% or More of Total Amount of Retained Austenite It has been found that excellent deep drawability can be obtained by setting the average size of retained austenite at 0.5 μm and setting the ratio (volume ratio) of retained austenite having a grain size of 1.0 μm or more to the total amount of retained austenite at 2% or more.

If incoming stress of a flange portion is smaller than tensile stress of a vertical wall portion formed during deep drawing, drawing is easily advanced, and thus good deep drawability can be obtained. Regarding the deformation behavior of the flange portion, since compressive stress is applied from the board surface direction and circumference, formation occurs in a state where isotropic compressive stress is applied. Meanwhile, martensitic transformation is accompanied by volume expansion, so that martensitic transformation hardly occurs under isotropic compressive stress. Therefore, strain induced martensitic transformation of retained austenite at the flange portion is suppressed to reduce work hardening.

As a result, the deep drawability is improved. As the size of retained austenite increases, the greater effect of suppressing martensitic transformation is exhibited.

In order to increase the tensile stress of the vertical wall portion formed by deep drawing, it is necessary to maintain a high work hardening rate during deformation. Unstable retained austenite that easily undergoes strain induced transformation under relatively low stress and stable retained austenite that does not undergo strain induced transformation unless high stress is applied are allowed to coexist to cause strain induced transformation over a wide stress range, thus making it possible to maintain a high work hardening rate during deformation. Meanwhile, coarse unstable retained austenite might transform into hard martensite by deformation-induced transformation during stretch flange deformation such as hole expansion or impact deformation, thus causing local strain concentration at the hard phase/matrix interface leading to a starting point of fracture. Therefore, a steel sheet structure having these properties was studied by including a predetermined amount of each of coarse unstable retained austenite and fine stable retained austenite. Thus, the inventors of the present invention have found that a high work hardening rate is maintained during deformation by setting the average size of retained austenite at 0.5 μm and setting the ratio (volume ratio) of the amount of retained austenite having a grain size of 1.0 μm or more to the total amount of retained austenite at 2% or more, thus making it possible to obtain excellent deep drawability (LDR).

As mentioned above, when retained austenite undergoes strain induced transformation, the TRIP phenomenon occurs and high elongation can be obtained. Meanwhile, the martensitic structure formed by strain induced transformation is hard and acts as a starting point of fracture. Larger martensite structure easily acts as the starting point of fracture. It is also possible to obtain the effect of suppressing fracture by setting the average size of retained austenite at 0.5 μm or less to reduce the size of martensite formed due to strain induced transformation.

It is possible to determine the average size of retained austenite and the ratio of the amount of retained austenite having a grain size of 1.0 μm or more to the total amount of retained austenite by creating a Phase map using EBSD (electron back scatter diffraction patterns) method that is a crystal analysis method using SEM. An area of each austenite phase (retained austenite) is obtained from the obtained Phase map and an equivalent circle diameter (diameter) of each austenite phase is obtained from the area, and then an average of the obtained diameters is taken as the average size of retained austenite. It is possible to obtain the ratio of retained austenite having a grain size of 1.0 μm or more to the total amount of retained austenite by integrating the area of the austenite phase having an equivalent circle diameter of 1.0 μm or more to determine the ratio of austenite phase to the total area of the austenite phase. The thus obtained ratio of the retained austenite having a grain size of 1.0 μm or more to the total amount of retained austenite is the area ratio and is equivalent to the volume ratio.

2. Composition

The composition of the high-strength sheet according to the embodiments of the present invention will be described below. First, main elements C, Si, Al, Mn, P, S and Ti will be described, and then elements that may be selectively added will be described.

Note that all percentages as unit with respect to the composition are % by mass.

(1) C: 0.15 to 0.35%

C is an element indispensable for ensuring properties such as high (TS×EL) by obtaining the desired structure. Also, C is an element that is effective in improving the deep drawability by stabilizing retained austenite to ensure an required amount of retained austenite. In order to effectively exhibit such effects, it is necessary to add C in the amount of 0.15% or more. However, the amount of more than 0.35% is not suitable for welding, thus failing to obtain sufficient welding strength. The amount is preferably 0.18% or more, and more preferably 0.20% or more. The amount is preferably 0.30% or less. If the C amount is 0.30% or less, welding can be easily performed.

(2) Total of Si and Al: 0.5 to 3.0%

Si and Al each have an effect of suppressing precipitation of cementite, thus accelerating formation of retained austenite. In order to effectively exhibit such effect, it is necessary to add Si and Al in the total amount of 0.5% or more. However, if the total amount of Si and Al exceeds 3.0%, retained austenite is coarse, thus degrading the hole expansion ratio. The total amount is preferably 0.7% or more, and more preferably 1.0% or more. The total amount is preferably 2.5% or less, and more preferably 2.0% or less.

Note that Al may be added in an amount enough to function as a deoxidizing element, i.e., may be less than 0.10% by mass. For example, for the purpose of suppressing formation of cementite to increase the amount of retained austenite, Al may be added in a larger amount of 0.7% by mass or more.

(3) Mn: 1.0 to 4.0%

Mn suppresses formation of ferrite. In order to effectively exhibit such effect, it is necessary to add Mn in the amount of 1.0% or more. However, if the amount exceeds 4.0%, bainite transformation is suppressed, thus failing to form relatively coarse retained austenite. Therefore, it is impossible to improve the deep drawability. The content of Mn is preferably 1.5% or more, and more preferably 2.0% or more. The content is preferably 3.5% or less.

(4) P: 0.05% or Less (Including 0%)

P inevitably exists as an impurity element. If more than 0.05% of P exists, EL and X are degraded. Therefore, the content of P is set at 0.05% or less (including 0%). Preferably, the content is 0.03% or less (including 0%).

(5) S: 0.01% or Less (Including 0%)

S inevitably exists as an impurity element. If more than 0.01% of S exists, sulfide-based inclusions such as MnS are formed, which act as a starting point of cracking, thus degrading λ. Therefore, the content of S is set at 0.01% or less (including 0%). The content is preferably 0.005% or less (including 0%).

(6) Ti: 0.01% to 0.2%

Ti is an element that has an effect of precipitation strengthening and structure refining and is useful for achieving higher strength and improving the impact value. In order to effectively exhibit such effects, it is necessary to contain in the amount of 0.01% or more, and it is recommended to contain in the amount of 0.02% or more. However, the effects are saturated even if this element is added excessively, resulting in economic waste. Therefore, Ti is added in the amount of 0.2% or less, and preferably 0.1% or less.

(7) Balance

In a preferred embodiment, the balance is composed of iron and inevitable impurities. As inevitable impurities, it is permitted to mix trace elements (e.g., As, Sb, Sn, etc.) introduced according to conditions of raw materials, materials, manufacturing facilities and the like. There are elements whose content is preferably as small as possible, for example like P and S, that are therefore inevitable impurities in which the composition range is separately defined as mentioned above. Therefore, "inevitable impurities" constituting the balance as used herein means the concept excluding the elements whose composition ranges are separately defined.

The present invention is not limited to the composition of the above embodiments. As long as properties of the high-strength steel sheet according to the embodiments of the present invention can be maintained, arbitrary other element may be further contained. Other elements capable of being selectively contained in such manner will be mentioned below.

(8) One or More of Cu, Ni, Mo, Cr and B: Total Content of 1.0% or Less

These are elements that are useful as steel strengthening elements and are effective in stabilizing retained austenite to ensure a predetermined amount thereof. In order to effectively exhibit such effects, it is recommended to contain these elements in the total amount of 0.001% or more, and further 0.01% or more. However, the effects are saturated even if these elements are excessively contained, resulting in economic waste. Therefore, these elements are contained in the total amount of 1.0% or less, and preferably 0.5% or less.

(9) One or More of V, Nb, Mo, Zr and Hf: Total Content of 0.2% or Less

These are elements that have effects of precipitation strengthening and structure refining and are useful for achieving higher strength. In order to effectively exhibit such effects, it is recommended to contain these elements in the total amount of 0.01% or more, and further 0.02% or more. However, the effects is saturated even if these elements are excessively contained, resulting in economic waste. Therefore, these elements are contained in the total amount of 0.2% or less, and preferably 0.1% or less.

(10) One or More of Ca, Mg and REM: Total Content of 0.01% or Less

These are elements that are effective in controlling form of sulfides in steel to improve workability. Here, REM (rare earth element) used in the embodiments of the present invention include Sc, Y, lanthanoid and the like. In order to effectively exhibit such effect, it is recommended to contain these elements in the total amount of 0.001% or more, and further 0.002% or more. However, the effect is saturated even if these elements are excessively contained, resulting in economic waste. Therefore, these elements are contained in the total amount of 0.01% or less, and preferably 0.005% or less.

3. Properties

As mentioned above, regarding the high-strength sheet according to the embodiments of the present invention, all of TS, YR, TS×EL, LDR, λ, SW cross tension and low-temperature toughness are at a high level. These properties of the high-strength sheet according to the embodiments of the present invention will be described in detail below.

(1) Tensile Strength (TS)

The high-strength sheet has TS of 980 MPa or higher. This makes it possible to ensure sufficient strength.

(2) Yield Ratio (YR)

The high-strength sheet has the yield ratio of 0.75 or more. This makes it possible to realize a high yield strength combined with the above-mentioned high tensile strength and to use a final product under high stress, which is obtained by working such as deep drawing. Preferably, the high-strength sheet has the yield ratio of 0.80 or more.

(3) The Product (TS×EL) of Tensile Strength (TS) and Total Elongation (EL)

TS×EL is 20,000 MPa % or more. By having TS×EL of 20,000 MPa % or more, it is possible to obtain high-level strength-ductility balance that has both high strength and high ductility simultaneously. Preferably, TS×EL is 23,000 MPa % or more.

(4) Deep Drawability (LDR)

LDR is an index used for evaluation of the deep drawability. In cylindrical drawing, D/d is referred to as LDR (limiting drawing ratio), where d denotes a diameter of a cylinder obtained in cylindrical drawing and D denotes a maximum diameter of a disk-shaped steel sheet (blank) capable of obtaining a cylinder without causing fracture by one deep drawing process. More specifically, disk-shaped samples having a thickness of 1.4 mm and various diameters are subjected to cylindrical deep drawing using a die having a punch diameter of 50 mm, a punch angle radius of 6 mm, a die diameter of 55.2 mm and a die angle radius of 8 mm. It is possible to obtain LDR by determining a maximum sample diameter (maximum diameter D) among the sample diameters of the disc-shaped samples that were drawn without causing fracture.

The high-strength sheet according to the embodiments of the present invention has LDR of 2.00 or more, and preferably 2.05 or more, and thus has excellent deep drawability.

(5) Hole Expansion Ratio (λ)

The hole expansion ratio λ is determined in accordance with Japanese Industrial Standards JIS Z 2256. A punched hole having a diameter $d_0$ ($d_0$=10 mm) is formed in a test piece and a punch having a tip angle of 60° pushed into this punched hole, and a diameter d of the punched hole at the time when generated cracking penetrated the thickness of the test piece is measured, and then the hole expansion ratio is calculated by the following formula.

$$\Delta(\%)=\{(d-d_0)/d_0\}\times 100$$

The high-strength sheet according to the embodiments of the present invention has the hole expansion ratio λ of 20% or more, and preferably 30% or more. This makes it possible to obtain excellent workability such as press formability.

(6) Cross Tensile Strength of Spot Welded Portion (SW Cross Tension)

The cross tensile strength of the spot welded portion is evaluated in accordance with Japanese Industrial Standards JIS Z 3137. Conditions of spot welding are as follows. Using two steel sheets (1.4 mm-thick steel sheets in Examples mentioned later) laid one upon another, spot welding is performed under a welding pressure of 4 kN at a current pitch of 0.5 kA in a range from 6 kA to 12 kA by a dome radius type electrode, thereby determining the minimum current value at which dust is generated. Then, the cross tensile strength of a cross joint is measured, which is obtained by spot-welding at a current that is 0.5 kA lower than the minimum current value at which dust is generated.

In the high-strength sheet according to the embodiments of the present invention, the cross tensile strength of the spot welded portion (SW cross tension) is 6 kN or more, preferably 8 kN or more, and more preferably 10 kN or more.

(7) Low-Temperature Toughness

Low-temperature toughness can be determined from the Charpy impact test value at −40° C. in accordance with Japanese Industrial Standards JIS Z 2242. A test piece having a shape (test piece width: the same thickness as that of the steel plate (as-rolled) (1.4 mm in thickness), height: 10 mm, length: 55 mm, and a notch shape (notch angle: 45°, notch depth: 2 mm, notch root radius: 0.25 mm)) was fabricated and then subjected to evaluation.

The high-strength sheet according to the embodiments of the present invention has excellent low-temperature toughness, i.e., the Charpy impact test value at −40° C. is 60 J/cm$^2$ or more, and preferably 70 J/cm$^2$ or more.

4. Manufacturing Method

The method for manufacturing a high-strength sheet according to the present invention will be described below.

The inventors of the present application have found that the above-mentioned desired steel structure is attained by subjecting a rolled material with predetermined composition to a heat treatment (multi-step austempering treatment) mentioned later, thus obtaining a high-strength steel sheet having the above-mentioned desired properties.

Details will be described below.

FIG. 1 is a diagram explaining a method for manufacturing a high-strength sheet according to the embodiments of the present invention, especially a heat treatment.

The rolled material to be subjected to the heat treatment is usually produced by cold-rolling after subjecting to hot-rolling. However, the process is not limited thereto, and the rolled material may be produced by any one of hot-rolling and cold-rolling. The conditions of hot-rolling and cold-rolling are not particularly limited.

(1) Austenitizing Treatment

As shown in [1] and [2] of FIG. 1, a rolled material is heated to a temperature of an $Ac_3$ point or higher, thereby the rolled material is austenitized. The rolled material may be held at this heating temperature for 1 to 1,800 seconds.

If the heating is lower than the $Ac_3$ point, austenitization does not sufficiently progress, and this leads to excess amount of ferrite in the final steel sheet. In addition, because of insufficient progress of austenitization, austenite is insufficient and martensite obtained from austenite is insufficient, and as a result, total amount of tempered martensite and tempered bainite are insufficient.

The heating temperature is the $Ac_3$ point or higher, and the $Ac_3$ point+100° C. or lower. Grain coarsening of prior austenite can be suppressed by setting at the temperature of the $Ac_3$ point+100° C. or lower. The heating temperature is preferably the $Ac_3$ point+10° C. or higher and the $Ac_3$ point+90° C. or lower, and more preferably the $Ac_3$ point+20° C. or higher and the $Ac_3$ point+80° C. or lower. This is because the formation of ferrite can be more completely suppressed and grain coarsening can be more surely suppressed by more complete austenitization.

Heating during austenitization shown in [1] of FIG. 1 may be performed at an arbitrary heating rate, and the average heating rate is preferably 1° C./sec or more and less than 20° C./sec.

The $Ac_3$ point can be determined using the following formula:

$$Ac_3\ \text{point}\ (^\circ\ C.)=911-203\times\sqrt{[C]}+44.7\times[Si]-30\times[Mn]+400\times[Al]$$

where [ ] each denote the content in % by mass of each element.

(2) Cooling and Retaining at Temperature in Range of 300° C. to 500° C.

After the austenitization, cooling is performed, followed by retention at a temperature in a range of 300° C. to 500° C. at a cooling rate of 10° C./sec or less for 10 seconds or more and less than 300 seconds, as shown in [5] of FIG. 1.

Cooling is performed at an average cooling rate of 15° C./sec or more and less than 200° C./sec between at least 650° C. and 500° C. This is because the formation of ferrite during cooling is suppressed by setting the average cooling rate at 15° C./sec or more. It is also possible to prevent the occurrence of excessive thermal strain due to rapid cooling by setting the cooling rate at less than 200° C./sec. Preferred example of such cooling includes cooling to a rapid cooling starting temperature of 650° C. or higher at relatively low average cooling rate of 0.1° C./sec or more and 10° C./sec or less, as shown in [3] of FIG. 1, followed by cooling from the rapid cooling starting temperature to a retention starting temperature of 500° C. or lower at an average cooling rate of 20° C./sec or more and less than 200° C./sec, as shown in [4] of FIG. 1.

Retention is performed at a temperature in a range of 300° C. to 500° C. at a cooling rate of 10° C./sec or less for 10 seconds or more and less than 300 seconds. In other words, the material is left to stand at a temperature in a range of 300° C. to 500° C. in a state where the cooling rate is 10° C./sec or less for 10 seconds or more and less than 300 seconds. The state where the cooling rate is 10° C./sec or less also includes the case of holding at substantially constant temperature (i.e., cooling rate is 0° C./sec), as shown in [5] of FIG. 1.

This retention enables partial formation of bainite. Since bainite has solid solubility limit of carbon that is lower than that of austenite, carbon exceeding the solid solubility limit is discharged from bainite, and thus a region of austenite, in which carbon is concentrated, is formed around bainite.

After cooling and reheating mentioned later, this region becomes somewhat coarse retained austenite. By forming this somewhat coarse retained austenite, it is possible to enhance the deep drawability as mentioned above.

If the retention temperature is higher than 500° C., since the carbon-concentrated region is excessively large and the average size of retained austenite is large, and thus the hole expansion ratio and low-temperature toughness are degraded. Meanwhile, if the retention temperature is lower than 300° C., the carbon-concentrated region is small and the amount of coarse retained austenite is insufficient, and thus the deep drawability is degraded.

If the retention time is less than 10 seconds, the area of the carbon-concentrated region is small and the amount of coarse retained austenite is insufficient, and thus the deep drawability is degraded. Meanwhile, if the retention time is 300 seconds or more, since the carbon-concentrated region is excessively large, and the average size of retained austenite is large, and thus the hole expansion ratio and low-temperature toughness are degraded.

If the cooling rate during retention is more than 10° C./sec, since sufficient bainite transformation does not occur, sufficient carbon-concentrated region is not formed, and this leads to insufficient amount of coarse retained austenite.

Therefore, retention is performed at a temperature in a range of 300° C. to 500° C. at a cooling rate of 10° C./sec or less for 10 seconds or more and less than 300 seconds. Retention is preferably performed at a temperature in a range of 320° C. to 480° C. at a cooling rate of 8° C./sec or less for 10 seconds or more and, during the retention, holding is preferably performed at a constant temperature for 3 seconds to 80 seconds.

Retention is more preferably performed at a temperature in a range of 340° C. to 460° C. at a cooling rate of 3° C./sec or less for 10 seconds or more and, during the retention, holding is performed at a constant temperature for 5 seconds to 60 seconds.

(3) Cooling to Cooling Stopping Temperature Between 100° C. or Higher and Lower than 300° C.

After the above-mentioned retention, as shown in [6] of FIG. 1, cooling is performed from a second cooling starting temperature of 300° C. or higher to a cooling stopping temperature of 100° C. or higher and lower than 300° C. at an average cooling rate of 10° C./sec or more. In one of preferred embodiments, as shown in [6] of FIG. 1, the above-mentioned retention end temperature (e.g., holding temperature shown in [5] of FIG. 1) is taken as the second cooling starting temperature.

This cooling causes martensitic transformation while leaving the above-mentioned carbon-concentrated region as austenite. By controlling the cooling stopping temperature at a temperature in a range of 100° C. or higher and lower than 300° C., the amount of austenite remaining without being transformed into martensite is adjusted, and final amount of retained austenite is controlled.

If the cooling rate is less than 10° C./sec, the carbon-concentrated region expands more than necessary during cooling and the average size of retained austenite is large, and thus the hole spreading ratio and low-temperature toughness are degraded. If the cooling stopping temperature is lower than 100° C., the amount of retained austenite is insufficient. As a result, TS increases but EL decreases, and this leads to insufficient TS×EL balance.

If the cooling stopping temperature is 300° C. or higher, coarse unmodified austenite increases and remains even after the subsequent cooling. Finally, the size of retained austenite is large, and thus the hole expansion ratio λ is degraded.

The cooling rate is preferably 15° C./sec or more, and the cooling stopping temperature is preferably 120° C. or higher and 280° C. or lower. The cooling rate is more preferably 20° C./sec or more, and the cooling stopping temperature is more preferably 140° C. or higher and 260° C. or lower.

As shown in [7] of FIG. 1, holding may be performed at the cooling stopping temperature. In the case of holding, the holding time is preferably 1 second to 600 seconds. Even if the holding time increases, there is almost no influence on properties. However, the holding time of more than 600 seconds degrades the productivity.

(4) Reheating to Temperature in range of 300° C. to 500° C.

As shown in [8] of FIG. 1, heating is performed from the above cooling stopping temperature to a reheating temperature in a range of 300° C. to 500° C. The heating rate is not particularly limited. After reaching the reheating temperature, holding is preferably performed at the same temperature, as shown in [9] of FIG. 1. The holding time is preferably 50 seconds to 1,200 seconds.

This reheating expels carbon in martensite to accelerate the condensation of carbon in austenite around martensite, and this leads to stabilization of austenite. This makes it possible to increase the amount of retained austenite obtained finally.

If the reheating temperature is lower than 300° C., diffusion of carbon is insufficient, and sufficient amount of retained austenite is not obtained, and this leads to a decrease in TS×EL. If the amount of retained austenite is insufficient, the amount of retained austenite having a grain size of 1 μm or more is also easy to be insufficient.

If the reheating temperature is higher than 500° C., carbon is precipitated as cementite, so that the condensation of carbon in austenite is insufficient. Thus sufficient amount of retained austenite is not obtained, and this leads to a decrease in TS×EL. If the amount of retained austenite is insufficient, the amount of retained austenite having a grain size of 1 μm or more is also insufficient. In addition, if the reheating temperature is higher than 500° C. and the condensation of carbon in austenite is insufficient, a fresh martensite fraction is large, and thus the impact value is decreased.

If holding is not performed or the holding time is less than 50 seconds, carbon diffusion may be insufficient, similarly. Therefore, it is preferred to hold at a reheating temperature for 50 second or more.

If the holding time is more than 1,200 seconds, carbon may precipitate as cementite, similarly. Therefore, the holding time is preferably 1,200 seconds or less.

The reheating temperature is preferably 320° C. to 480° C. and, in this case, the upper limit of the holding time is preferably 900 seconds. The reheating temperature is more preferably 340° C. to 460° C. and, in this case, the upper limit of the holding time is preferably 600 seconds.

After reheating, as shown in [10] of FIG. 1, cooling may be performed to the temperature of 200° C. or lower, for example, room temperature. The average cooling rate to 200° C. or lower is preferably 10° C./sec or more.

The high-strength sheet according to the embodiments of the present invention can be obtained by the above-mentioned heat treatment.

There is a possibility that a person skilled in the art, who contacted the method of manufacturing a high-strength steel sheet according to the embodiments of the present invention described above, can obtain the high strength steel sheet according to the embodiments of the present invention by trial and error, using a manufacturing method different from the above-mentioned method.

EXAMPLES

1. Fabrication of Samples

After producing each cast material with the chemical composition shown in Table 1 by vacuum melting, each of this cast materials was hot-forged to form a steel sheet having a thickness of 30 mm and then hot-rolled. In Table 1, $Ac_3$ points calculated from the compositions are also shown.

Although the conditions of hot-rolling do not have a substantial influence on the final structure and properties of the present patent, a steel sheet having a thickness of 2.5 mm was produced by multistage rolling after heating to 1,200° C. At this time, the end temperature of hot-rolling was set at 880° C. After that, cooling was performed to 600° C. at 30° C./sec, and then cooling was stopped. The steel sheet was inserted into a furnace heated to 600° C., held for 30 minutes and then furnace-cooled to obtain a hot-rolled steel sheet.

The hot-rolled steel sheet was subjected to pickling to remove the scale on the surface, and then cold-rolled to reduce the thickness to 1.4 mm. This cold rolled sheet was subjected to a heat treatment to obtain samples. The heat treatment conditions are shown in Table 2. The number in parentheses, for example, [2] in Table 2 corresponds to the process of the same number in parentheses in FIG. 1. In Table 2, samples Nos. 1, 2, 20 and 29 are samples that were not retained at a temperature in a range of 300 to 500° C. at a cooling rate of 10° C./sec or less for 10 seconds or more in the step corresponding to [5] of FIG. 1. More specifically, these samples are samples (samples in which the steps corresponding to [5] and [6] in FIG. 1 were skipped) that were immediately cooled to 200° C. after starting rapid cooling at 700° C. Sample No. 7 is sample (sample in which the steps corresponding to [6] to [8] in FIG. 1 were skipped) that was not cooled to a cooling stopping temperature between 100° C. or higher and lower than 300° C.

In Table 1 to Table 4, the underlined numerical values indicate that these deviate from the range of the embodiments of the present invention. It should be noted that "-" is not underlined, although these deviate from the range of the embodiments of the present invention.

TABLE 1

| | Composition | | | | | | | | | | |
|---|---|---|---|---|---|---|---|---|---|---|---|
| Steel No. | C % by mass | Si % by mass | Mn % by mass | P % by mass | S % by mass | Al % by mass | Ti % by mass | Si + Al % by mass | Others % by mass | $Ac_3$ ° C. | $Ac_3$ + 100 ° C. |
| a | 0.28 | 1.32 | 1.98 | 0.015 | 0.003 | 0.02 | 0.08 | 1.3 | | 811 | 911 |
| b | 0.25 | 1.35 | 2.01 | 0.009 | 0.003 | 0.03 | 0.00 | 1.4 | | 822 | 922 |
| c | 0.18 | 1.09 | 2.09 | 0.013 | 0.002 | 0.03 | 0.11 | 1.1 | | 823 | 923 |
| d | 0.32 | 1.58 | 1.93 | 0.007 | 0.002 | 0.02 | 0.10 | 1.6 | | 817 | 917 |
| e | 0.21 | 2.09 | 1.78 | 0.012 | 0.001 | 0.04 | 0.10 | 2.1 | | 874 | 974 |
| f | 0.12 | 1.41 | 2.50 | 0.010 | 0.002 | 0.04 | 0.09 | 1.5 | | 845 | 945 |
| g | 0.19 | 1.26 | 5.18 | 0.009 | 0.002 | 0.04 | 0.11 | 1.3 | | 739 | 839 |
| h | 0.21 | 1.53 | 0.61 | 0.015 | 0.001 | 0.04 | 0.09 | 1.6 | | 884 | 984 |
| i | 0.25 | 0.20 | 2.18 | 0.007 | 0.001 | 0.03 | 0.10 | 0.2 | | 765 | 865 |
| j | 0.45 | 1.51 | 1.67 | 0.011 | 0.002 | 0.02 | 0.09 | 1.5 | | 800 | 900 |
| k | 0.29 | 3.20 | 1.60 | 0.014 | 0.001 | 0.03 | 0.10 | 3.2 | | 909 | 1,009 |
| l | 0.24 | 1.05 | 1.75 | 0.010 | 0.002 | 0.04 | 0.07 | 1.1 | | 822 | 922 |
| m | 0.28 | 1.10 | 1.96 | 0.007 | 0.002 | 0.02 | 0.10 | 1.1 | | 802 | 902 |
| n | 0.29 | 1.50 | 2.19 | 0.015 | 0.003 | 0.04 | 0.10 | 1.5 | | 819 | 919 |
| o | 0.23 | 1.26 | 2.24 | 0.006 | 0.002 | 0.03 | 0.10 | 1.3 | | 815 | 915 |
| p | 0.21 | 1.62 | 1.99 | 0.006 | 0.002 | 0.04 | 0.08 | 1.7 | | 847 | 947 |
| q | 0.29 | 1.29 | 1.84 | 0.014 | 0.002 | 0.03 | 0.09 | 1.3 | | 816 | 916 |
| r | 0.28 | 0.83 | 2.31 | 0.008 | 0.002 | 0.25 | 0.07 | 1.1 | | 871 | 971 |
| s | 0.20 | 1.42 | 2.24 | 0.010 | 0.003 | 0.02 | 0.10 | 1.4 | | 824 | 924 |
| t | 0.21 | 1.26 | 1.80 | 0.007 | 0.001 | 0.04 | 0.11 | 1.3 | | 836 | 936 |
| u | 0.28 | 1.28 | 1.98 | 0.010 | 0.002 | 0.02 | 0.07 | 1.3 | Cu: 0.2 | 809 | 909 |
| v | 0.27 | 1.25 | 2.03 | 0.012 | 0.003 | 0.03 | 0.08 | 1.3 | Ni: 0.2 | 812 | 912 |
| w | 0.30 | 1.28 | 1.98 | 0.009 | 0.002 | 0.02 | 0.07 | 1.3 | Cr: 0.1 | 806 | 906 |
| x | 0.29 | 1.29 | 1.96 | 0.008 | 0.001 | 0.03 | 0.05 | 1.3 | Mo: 0.1 | 813 | 913 |
| y | 0.28 | 1.33 | 1.98 | 0.009 | 0.001 | 0.03 | 0.03 | 1.4 | B: 0.002 | 816 | 916 |
| z | 0.25 | 1.28 | 1.97 | 0.011 | 0.002 | 0.04 | 0.06 | 1.3 | V: 0.05 | 824 | 924 |
| aa | 0.26 | 1.27 | 2.04 | 0.010 | 0.003 | 0.03 | 0.05 | 1.3 | Nb: 0.05 | 815 | 915 |
| ab | 0.27 | 1.30 | 1.98 | 0.010 | 0.002 | 0.03 | 0.06 | 1.3 | Mg: 0.002 | 816 | 916 |
| ac | 0.31 | 1.33 | 1.99 | 0.012 | 0.003 | 0.03 | 0.08 | 1.4 | REM: 0.002 | 810 | 910 |

TABLE 2

| | | Heat treatment conditions | | | | | | |
|---|---|---|---|---|---|---|---|---|
| No. | Steel No. | [1] Heating rate ° C./sec | [1] Heating temperature ° C. | [2] Holding time Sec | [3] Cooling rate ° C./sec | [4] Rapid cooling starting temperature ° C. | [4] Cooling rate ° C./sec | [5] Holding temperature ° C. |
| 1 | a | 10 | 850 | 120 | 10 | 700 | 28 | — |
| 2 | a | 10 | 850 | 120 | 10 | 700 | 28 | 400 |
| 3 | a | 10 | 850 | 120 | 10 | 700 | 28 | 400 |

TABLE 2-continued

| | | | | | | | | |
|---|---|---|---|---|---|---|---|---|
| 4 | a | 10 | 850 | 120 | 10 | 700 | 28 | 400 |
| 5 | a | 10 | 850 | 120 | 10 | 700 | 28 | 550 |
| 6 | a | 10 | 850 | 120 | 10 | 700 | 28 | 250 |
| 7 | a | 10 | 850 | 120 | 10 | 700 | 28 | 400 |
| 8 | a | 10 | 780 | 120 | 10 | 700 | 28 | 400 |
| 9 | a | 10 | 940 | 120 | 10 | 700 | 28 | 400 |
| 10 | a | 10 | 850 | 120 | 10 | 700 | 28 | 400 |
| 11 | a | 10 | 850 | 120 | 10 | 700 | 28 | 400 |
| 12 | a | 10 | 850 | 120 | — | 850 | 28 | 400 |
| 13 | a | 10 | 850 | 120 | 10 | 580 | 28 | 400 |
| 14 | a | 10 | 850 | 120 | 10 | 700 | 28 | 400 |
| 15 | a | 10 | 850 | 120 | 10 | 700 | 8 | 400 |
| 16 | a | 10 | 850 | 120 | 10 | 700 | 28 | 400 |
| 17 | a | 10 | 850 | 120 | 10 | 700 | 28 | 400 |
| 18 | a | 10 | 850 | 120 | 10 | 700 | 28 | 400 |
| 19 | a | 10 | 850 | 120 | 10 | 700 | 28 | 400 |
| 20 | b | 10 | 850 | 120 | 10 | 700 | 28 | — |
| 21 | b | 10 | 850 | 120 | 10 | 700 | 28 | 400 |
| 22 | c | 10 | 850 | 120 | 10 | 700 | 28 | 400 |
| 23 | d | 10 | 850 | 120 | 10 | 700 | 28 | 400 |
| 24 | e | 10 | 900 | 120 | 10 | 700 | 28 | 400 |
| 25 | f | 10 | 900 | 120 | 10 | 700 | 28 | 400 |
| 26 | g | 10 | 800 | 120 | 10 | 700 | 28 | 400 |
| 27 | h | 10 | 900 | 120 | 10 | 700 | 28 | 400 |
| 28 | i | 10 | 850 | 120 | 10 | 700 | 28 | 400 |
| 29 | j | 10 | 850 | 120 | 10 | 700 | 28 | — |
| 30 | k | 10 | 940 | 120 | 10 | 700 | 28 | 400 |
| 31 | l | 10 | 850 | 120 | 10 | 700 | 28 | 400 |
| 32 | m | 10 | 850 | 120 | — | 850 | 28 | 400 |
| 33 | n | 10 | 850 | 120 | — | 850 | 28 | 400 |
| 34 | o | 10 | 850 | 120 | — | 850 | 28 | 400 |
| 35 | p | 10 | 900 | 120 | — | 850 | 28 | 400 |
| 36 | q | 10 | 850 | 120 | — | 850 | 28 | 400 |
| 37 | r | 10 | 900 | 120 | — | 850 | 28 | 400 |
| 38 | s | 10 | 850 | 120 | — | 850 | 28 | 400 |
| 39 | t | 10 | 850 | 120 | — | 850 | 28 | 400 |
| 40 | u | 10 | 850 | 120 | 10 | 700 | 28 | 400 |
| 41 | v | 10 | 850 | 120 | 10 | 700 | 28 | 400 |
| 42 | w | 10 | 850 | 120 | 10 | 700 | 28 | 400 |
| 43 | x | 10 | 850 | 120 | 10 | 700 | 28 | 400 |
| 44 | y | 10 | 850 | 120 | 10 | 700 | 28 | 400 |
| 45 | z | 10 | 850 | 120 | 10 | 700 | 28 | 400 |
| 46 | aa | 10 | 850 | 120 | 10 | 700 | 28 | 400 |
| 47 | ab | 10 | 850 | 120 | 10 | 700 | 28 | 400 |
| 48 | ac | 10 | 850 | 120 | 10 | 700 | 28 | 400 |

| | Heat treatment conditions | | | | | | |
|---|---|---|---|---|---|---|---|
| No. | [5] Holding time Sec | [6] Cooling rate ° C./sec | [6] Cooling stopping temperature ° C. | [7] Holding time Sec | [8] Reheating temperature ° C. | [9] Holding time Sec | [10] Cooling rate ° C./sec |
| 1 | — | — | 200 | 50 | 400 | 300 | 10 |
| 2 | 300 | 30 | 200 | 50 | 400 | 300 | 10 |
| 3 | 50 | 1 | 200 | 50 | 400 | 300 | 10 |
| 4 | 3 | 30 | 200 | 50 | 400 | 300 | 10 |
| 5 | 50 | 30 | 200 | 50 | 400 | 300 | 10 |
| 6 | 50 | 30 | 200 | 50 | 400 | 300 | 10 |
| 7 | 300 | — | — | — | — | — | 10 |
| 8 | 50 | 30 | 200 | 50 | 400 | 300 | 10 |
| 9 | 50 | 30 | 200 | 50 | 400 | 300 | 10 |
| 10 | 50 | 30 | 200 | 50 | 400 | 300 | 10 |
| 11 | 50 | 30 | 20 | 50 | 400 | 300 | 10 |
| 12 | 50 | 30 | 200 | 50 | 400 | 300 | 10 |
| 13 | 50 | 30 | 200 | 50 | 400 | 300 | 10 |
| 14 | 50 | 30 | 200 | 50 | 400 | 300 | 10 |
| 15 | 50 | 30 | 200 | 50 | 400 | 300 | 10 |
| 16 | 50 | 30 | 200 | 50 | 550 | 300 | 10 |
| 17 | 50 | 30 | 200 | 50 | 250 | 300 | 10 |
| 18 | 50 | 30 | 200 | 50 | 350 | 300 | 10 |
| 19 | 50 | 30 | 200 | 50 | 420 | 260 | 10 |
| 20 | — | — | 200 | 50 | 400 | 300 | 10 |
| 21 | 50 | 30 | 200 | 50 | 400 | 300 | 10 |
| 22 | 50 | 30 | 200 | 50 | 400 | 300 | 10 |
| 23 | 50 | 30 | 200 | 50 | 400 | 300 | 10 |
| 24 | 50 | 30 | 200 | 50 | 400 | 300 | 10 |
| 25 | 50 | 30 | 200 | 50 | 400 | 300 | 10 |
| 26 | 50 | 30 | 200 | 50 | 400 | 300 | 10 |

TABLE 2-continued

| | | | | | | | |
|---|---|---|---|---|---|---|---|
| 27 | 50 | 30 | 200 | 50 | 400 | 300 | 10 |
| 28 | 50 | 30 | 200 | 50 | 400 | 300 | 10 |
| 29 | — | — | 200 | 50 | 450 | 300 | 10 |
| 30 | 50 | 30 | 200 | 50 | 400 | 300 | 10 |
| 31 | 50 | 30 | 200 | 50 | 400 | 300 | 10 |
| 32 | 50 | 30 | 200 | 50 | 400 | 300 | 10 |
| 33 | 50 | 30 | 200 | 50 | 400 | 300 | 10 |
| 34 | 50 | 30 | 200 | 50 | 400 | 300 | 10 |
| 35 | 50 | 30 | 200 | 50 | 400 | 300 | 10 |
| 36 | 50 | 30 | 200 | 50 | 400 | 300 | 10 |
| 37 | 50 | 30 | 200 | 50 | 400 | 300 | 10 |
| 38 | 50 | 30 | 200 | 50 | 400 | 300 | 10 |
| 39 | 50 | 30 | 200 | 50 | 400 | 300 | 10 |
| 40 | 50 | 30 | 200 | 50 | 400 | 300 | 10 |
| 41 | 50 | 30 | 200 | 50 | 400 | 300 | 10 |
| 42 | 50 | 30 | 200 | 50 | 400 | 300 | 10 |
| 43 | 50 | 30 | 200 | 50 | 400 | 300 | 10 |
| 44 | 50 | 30 | 200 | 50 | 400 | 300 | 10 |
| 45 | 50 | 30 | 200 | 50 | 400 | 300 | 10 |
| 46 | 50 | 30 | 200 | 50 | 400 | 300 | 10 |
| 47 | 50 | 30 | 200 | 50 | 400 | 300 | 10 |
| 48 | 50 | 30 | 200 | 50 | 400 | 300 | 10 |

2. Steel Structure

A cross-section of each sample parallel to the rolling direction was observed as the observed cross-section at a ¼ thickness position using a scanning electron microscope with an observation magnification of 3,000 times and then (i) the ferrite fraction and (ii) the total fraction of tempered martensite and tempered bainite (described as "tempered M/B" in Table 3) were determined by the methods mentioned above. (iii) In the measurement of the amount of retained austenite (amount of retained γ), a two-dimensional micro area X-ray diffraction apparatus (RINT-RAPID II) manufactured by Rigaku Corporation was used. In the measurements of (iv) the fresh martensite fraction, (v) the average size of retained austenite (average grain size of retained γ) and (vi) the ratio of retained austenite having a grain size of 1.0 μm or more to the total amount of retained austenite (described as "ratio of retained γ having a grain size of 1.0 μm or more" in Table 3), a field emission scanning electron microscope manufactured by JEOL Ltd. was used and, in the measurement of EBSD, OIM system manufactured by EDAX-TSL Inc. was used, and the measurement was performed at a measurement area of 30 μm×30 μm and a measurement interval of 0.1 μm. The results are shown in Table 3.

(vii) In the measurement of the prior austenite grain size (described as "Dγ" in Table 3), a cross-section of each sample parallel to the rolling direction was observed as the observation cross-section at a ¼ thickness position using an optical microscope with an observation magnification of 1,000 times and then the measurement was performed by the method mentioned above.

TABLE 3

| | | Structure | | | | | | |
|---|---|---|---|---|---|---|---|---|
| No. | Steel No. | (i) Ferrite % | (ii) Tempered M/B % | (iii) Amount of retained γ % | (iv) Fresh martensite % | (v) Average grain size of retained γ μm | (vi) Amount of retained γ having size of 1.0 μm or more % | (vii) Dγ μm |
| 1 | a | 0 | 69 | 14.2 | 3.4 | 0.34 | 0.68 | 7.83 |
| 2 | a | 0 | 70 | 16.6 | 3.2 | 1.30 | 3.12 | 5.38 |
| 3 | a | 0 | 71 | 17.1 | 4.0 | 1.34 | 2.93 | 5.84 |
| 4 | a | 0 | 68 | 16.2 | 3.2 | 0.49 | 0.70 | 6.82 |
| 5 | a | 0 | 71 | 16.9 | 2.8 | 1.12 | 2.95 | 6.37 |
| 6 | a | 0 | 70 | 16.3 | 2.1 | 0.17 | 0.81 | 6.57 |
| 7 | a | 0 | 0 | 19.2 | 3.2 | 1.41 | 5.40 | 5.23 |
| 8 | a | 33 | 38 | 16.3 | 3.0 | 0.16 | 2.42 | 5.98 |
| 9 | a | 0 | 67 | 18.2 | 2.6 | 0.83 | 2.51 | 11.53 |
| 10 | a | 0 | 73 | 18.7 | 2.2 | 0.11 | 3.46 | 5.27 |
| 11 | a | 0 | 84 | 5.2 | 2.8 | 0.16 | 0.96 | 5.87 |
| 12 | a | 0 | 71 | 17.1 | 2.2 | 0.21 | 2.50 | 5.79 |
| 13 | a | 0 | 71 | 17.0 | 2.4 | 0.17 | 2.91 | 6.18 |
| 14 | a | 0 | 71 | 17.5 | 2.2 | 0.20 | 2.59 | 5.93 |
| 15 | a | 23 | 45 | 13.1 | 2.8 | 0.15 | 2.71 | 5.43 |
| 16 | a | 0 | 73 | 6.9 | 8.2 | 0.19 | 1.21 | 6.26 |
| 17 | a | 0 | 52 | 7.4 | 2.7 | 0.22 | 1.13 | 5.67 |
| 18 | a | 0 | 72 | 16.4 | 3.1 | 0.18 | 2.99 | 5.83 |
| 19 | a | 0 | 74 | 17.3 | 2.1 | 0.17 | 2.63 | 5.96 |
| 20 | b | 0 | 69 | 12.4 | 3.9 | 0.15 | 0.65 | 12.82 |
| 21 | b | 0 | 70 | 17.1 | 3.4 | 0.71 | 2.87 | 13.38 |
| 22 | c | 0 | 73 | 15.9 | 2.7 | 0.17 | 2.53 | 6.18 |
| 23 | d | 0 | 72 | 18.2 | 2.4 | 0.16 | 2.61 | 5.93 |
| 24 | e | 0 | 73 | 14.1 | 3.5 | 0.17 | 2.48 | 6.07 |

TABLE 3-continued

| No. | Steel No. | Structure (i) Ferrite % | (ii) Tempered M/B % | (iii) Amount of retained γ % | (iv) Fresh martensite % | (v) Average grain size of retained γ μm | (vi) Amount of retained γ having size of 1.0 μm or more % | (vii) Dγ μm |
|---|---|---|---|---|---|---|---|---|
| 25 | f | 0 | 78 | 7.9 | 2.9 | 0.15 | 0.73 | 5.24 |
| 26 | g | 0 | 77 | 8.7 | 2.7 | 0.15 | 0.92 | 5.39 |
| 27 | h | 28 | 42 | 16.5 | 2.0 | 0.17 | 3.81 | 6.24 |
| 28 | i | 0 | 84 | 4.8 | 2.6 | 0.16 | 1.03 | 5.93 |
| 29 | j | 0 | 66 | 22.8 | 2.0 | 0.16 | 2.24 | 5.97 |
| 30 | k | 0 | 65 | 23.4 | 2.5 | 1.22 | 2.38 | 5.98 |
| 31 | l | 0 | 71 | 16.2 | 2.3 | 0.17 | 3.42 | 6.29 |
| 32 | m | 0 | 72 | 16.1 | 2.7 | 0.17 | 3.85 | 6.34 |
| 33 | n | 0 | 70 | 17.1 | 2.5 | 0.17 | 3.29 | 6.12 |
| 34 | o | 0 | 71 | 16.1 | 2.7 | 0.16 | 4.01 | 5.85 |
| 35 | p | 0 | 71 | 16.7 | 3.4 | 0.16 | 4.18 | 5.75 |
| 36 | q | 0 | 70 | 16.3 | 2.5 | 0.15 | 3.97 | 5.44 |
| 37 | r | 0 | 71 | 17.1 | 3.7 | 0.15 | 3.89 | 5.38 |
| 38 | s | 0 | 70 | 17.1 | 3.1 | 0.17 | 4.10 | 6.18 |
| 39 | t | 0 | 71 | 18.2 | 2.9 | 0.15 | 3.93 | 5.30 |
| 40 | u | 0 | 72 | 19.4 | 2.4 | 0.19 | 3.25 | 6.24 |
| 41 | v | 0 | 71 | 19.2 | 3.3 | 0.18 | 3.14 | 6.15 |
| 42 | w | 0 | 73 | 18.9 | 3.0 | 0.17 | 3.10 | 6.02 |
| 43 | x | 0 | 72 | 17.2 | 2.9 | 0.15 | 2.93 | 5.27 |
| 44 | y | 0 | 72 | 18.5 | 2.2 | 0.18 | 3.13 | 5.91 |
| 45 | z | 0 | 70 | 17.4 | 3.1 | 0.15 | 2.97 | 5.18 |
| 46 | aa | 0 | 71 | 17.1 | 2.5 | 0.14 | 2.94 | 5.21 |
| 47 | ab | 0 | 71 | 18.1 | 2.3 | 0.16 | 3.34 | 6.14 |
| 48 | ac | 0 | 71 | 18.2 | 1.9 | 0.17 | 3.41 | 6.28 |

3. Mechanical Properties

With respect to the obtained samples, the 0.2% proof stress (YS), the tensile strength (TS) and the total elongation (EL) were measured using a tensile tester, and YR and TS×EL were calculated. JIS No. 5 test pieces each having a tension axis perpendicular to the rolling direction were fabricated and then the tensile tests were performed. By the methods mentioned above, the hole expansion ratio λ, the deep drawability LDR, the cross tensile strength of the spot welded portion (SW cross tension), and the Charpy impact test value (impact value) at −40° C. were determined. The obtained results are shown in Table 4.

TABLE 4

| No. | Steel No. | Properties YS MPa | TS MPa | YR | EL % | TS × EL MPa % | Hole expansion ratio λ % | Deep drawability LDR | SW cross tension kN | Impact value J/cm$^2$ |
|---|---|---|---|---|---|---|---|---|---|---|
| 1 | a | 1,070 | 1,285 | 0.83 | 16.4 | 21,074 | 26 | 1.79 | 9.2 | 71.39 |
| 2 | a | 958 | 1,197 | 0.80 | 18.9 | 22,623 | 17 | 2.04 | 9.0 | 47.71 |
| 3 | a | 986 | 1,202 | 0.82 | 19.1 | 22,958 | 17 | 2.03 | 8.8 | 48.82 |
| 4 | a | 1,068 | 1,297 | 0.82 | 16.7 | 21,660 | 27 | 1.95 | 8.8 | 66.44 |
| 5 | a | 977 | 1,205 | 0.81 | 19.3 | 23,257 | 15 | 2.02 | 8.6 | 38.15 |
| 6 | a | 993 | 1,198 | 0.83 | 18.6 | 22,283 | 28 | 1.92 | 8.5 | 73.08 |
| 7 | a | 1,070 | 1,319 | 0.81 | 18.1 | 23,874 | 18 | 2.00 | 8.9 | 48.83 |
| 8 | a | 692 | 1,098 | 0.63 | 19.8 | 21,740 | 15 | 2.03 | 8.7 | 65.01 |
| 9 | a | 971 | 1,197 | 0.81 | 19.2 | 22,982 | 19 | 2.02 | 8.6 | 49.31 |
| 10 | a | 995 | 1,185 | 0.84 | 19.8 | 23,463 | 31 | 2.06 | 8.7 | 72.62 |
| 11 | a | 906 | 1,079 | 0.84 | 12.9 | 13,919 | 28 | 1.92 | 8.5 | 66.13 |
| 12 | a | 989 | 1,198 | 0.83 | 19.8 | 23,720 | 30 | 2.06 | 8.5 | 70.11 |
| 13 | a | 1,003 | 1,209 | 0.83 | 19.8 | 23,938 | 32 | 2.06 | 8.6 | 71.16 |
| 14 | a | 996 | 1,200 | 0.83 | 19.3 | 23,160 | 32 | 2.07 | 8.7 | 70.19 |
| 15 | a | 649 | 1,013 | 0.64 | 20.2 | 20,463 | 14 | 2.02 | 8.7 | 63.40 |
| 16 | a | 879 | 1,074 | 0.82 | 15.8 | 16,969 | 18 | 1.88 | 8.9 | 42.24 |
| 17 | a | 1,090 | 1321 | 0.83 | 13.4 | 17,701 | 27 | 1.95 | 8.9 | 64.30 |
| 18 | a | 1,002 | 1,197 | 0.84 | 18.1 | 21,666 | 31 | 2.07 | 8.5 | 70.57 |
| 19 | a | 965 | 1,188 | 0.81 | 19.5 | 23,166 | 33 | 2.06 | 8.4 | 71.56 |
| 20 | b | 1,012 | 1,234 | 0.82 | 17.1 | 21,101 | 22 | 1.78 | 9.8 | 46.18 |
| 21 | b | 956 | 1,186 | 0.81 | 19.5 | 23,127 | 14 | 2.06 | 9.6 | 45.27 |
| 22 | c | 996 | 1,205 | 0.83 | 18.1 | 21,811 | 31 | 2.07 | 10.2 | 70.16 |
| 23 | d | 1,000 | 1,205 | 0.83 | 19.6 | 23,618 | 32 | 2.08 | 8.5 | 70.07 |
| 24 | e | 966 | 1,198 | 0.81 | 17.9 | 21,444 | 31 | 2.06 | 11.1 | 71.02 |
| 25 | f | 840 | 1,021 | 0.82 | 16.6 | 16,949 | 27 | 1.92 | 13.3 | 72.96 |
| 26 | g | 855 | 1,038 | 0.82 | 14.8 | 15,362 | 26 | 1.87 | 7.7 | 71.28 |
| 27 | h | 639 | 1,037 | 0.62 | 19.3 | 20,014 | 16 | 2.03 | 13.1 | 62.52 |
| 28 | i | 993 | 1,200 | 0.83 | 15.1 | 18,120 | 28 | 1.95 | 11.5 | 65.52 |

TABLE 4-continued

| No. | Steel No. | YS MPa | TS MPa | YR | EL % | TS × EL MPa % | Hole expansion ratio λ % | Deep drawability LDR | SW cross tension kN | Impact value J/cm$^2$ |
|---|---|---|---|---|---|---|---|---|---|---|
| | | Properties | | | | | | | | |
| 29 | j | 1,223 | 1,487 | 0.82 | 14.1 | 20,967 | 24 | 2.02 | 3.8 | 65.11 |
| 30 | k | 1,102 | 1,392 | 0.79 | 14.5 | 20,184 | 17 | 2.02 | 7.9 | 40.19 |
| 31 | l | 999 | 1,200 | 0.83 | 17.8 | 21,360 | 30 | 2.06 | 11.3 | 71.23 |
| 32 | m | 986 | 1,206 | 0.82 | 18.1 | 21,829 | 31 | 2.05 | 10.1 | 71.54 |
| 33 | n | 998 | 1,206 | 0.83 | 19.8 | 23,879 | 30 | 2.05 | 8.5 | 70.40 |
| 34 | o | 1,000 | 1,205 | 0.83 | 19.4 | 23,377 | 31 | 2.07 | 10.9 | 71.53 |
| 35 | p | 1,004 | 1,199 | 0.84 | 17.5 | 20,983 | 31 | 2.07 | 11.3 | 72.61 |
| 36 | q | 993 | 1,202 | 0.83 | 17.6 | 21,155 | 31 | 2.05 | 9.3 | 70.60 |
| 37 | r | 976 | 1,207 | 0.81 | 19.7 | 23,778 | 32 | 2.05 | 9.7 | 70.73 |
| 38 | s | 983 | 1,205 | 0.82 | 19.8 | 23,859 | 30 | 2.07 | 11.2 | 71.24 |
| 39 | t | 1,003 | 1,199 | 0.84 | 19.7 | 23,620 | 30 | 2.05 | 12.1 | 72.25 |
| 40 | u | 979 | 1,194 | 0.82 | 20.2 | 24,119 | 32 | 2.06 | 9.6 | 68.12 |
| 41 | v | 977 | 1,189 | 0.82 | 20.1 | 23,899 | 31 | 2.06 | 9.6 | 67.34 |
| 42 | w | 974 | 1,192 | 0.82 | 20.1 | 23,959 | 31 | 2.09 | 9.1 | 65.60 |
| 43 | x | 1,021 | 1,225 | 0.83 | 19.1 | 23,398 | 31 | 2.07 | 9.8 | 72.61 |
| 44 | y | 994 | 1,213 | 0.82 | 19.7 | 23,896 | 31 | 2.08 | 9.5 | 65.73 |
| 45 | z | 990 | 1,228 | 0.81 | 19.2 | 23,578 | 30 | 2.06 | 10.8 | 72.35 |
| 46 | aa | 1,002 | 1,237 | 0.81 | 19.4 | 23,998 | 31 | 2.07 | 10.1 | 71.15 |
| 47 | ab | 978 | 1,193 | 0.82 | 18.7 | 22,309 | 35 | 2.08 | 9.5 | 68.90 |
| 48 | ac | 998 | 1,201 | 0.83 | 19.0 | 22,819 | 36 | 2.07 | 8.3 | 69.10 |

4. Conclusion

All of samples Nos. 10, 12 to 14, 18, 19, 22 to 24 and 31 to 48 that are samples of Examples satisfying the conditions of the embodiments of the present invention achieve 980 MPa or more of the tensile strength, 0.75 or more of the yield ratio, 20,000 MPa % or more of TS×EL, 2.00 or more of LDR, 20% or more of the hole expansion ratio, 6 kN or more of the SW cross tension, and 60 J/cm$^2$ or more of the impact value.

To the contrary, sample No. 1 exhibited insufficient amount of retained austenite having a grain size of 1.0 μm or more, thus failing to obtain sufficient deep drawability since retention was not performed at a temperature in a range of 300 to 500° C. after austenitization.

Sample No. 2 exhibited enlarged average grain size of retained austenite, thus degrading the hole expansion ratio and the impact value because of long retention time ("[5] Holding Time" shown in Table 2) at a temperature in a range of 300 to 500° C. after austenitization. Sample No. 3 exhibited enlarged average grain size of retained austenite, thus degrading the hole expansion ratio and the impact value because of low average cooling rate from the second cooling starting temperature ("[5] Holding Temperature" shown in Table 2) to the cooling stopping temperature.

Sample No. 4 exhibited insufficient amount of retained austenite having a grain size of 1.0 μm or more, thus failing to obtain sufficient deep drawability because of short holding time at a temperature in a range of 300 to 500° C. after austenitization.

Sample No. 5 exhibited enlarged average grain size of retained austenite, thus degrading the hole expansion ratio and the impact value since retention was performed at a temperature higher than a temperature in a range of 300 to 500° C. after austenitization.

Sample No. 6 exhibited insufficient amount of retained austenite having a grain size of 1.0 μm or more, thus failing to obtain sufficient deep drawability since retention was performed at a temperature lower than a temperature in a range of 300 to 500° C. after austenitization.

Sample No. 7 exhibited insufficient total amount of tempered martensite and tempered bainite, and enlarged average grain size of retained austenite, thus failing to obtain sufficient hole expansion property and the impact value since second cooling and a reheating treatment were not performed.

Sample No. 8 exhibited excessive amount of ferrite because of low heating temperature for austenitization. Excessive amount of ferrite led to insufficient formation of martensite and insufficient total amount of tempered martensite and tempered bainite, thus failing to obtain sufficient yield ratio and hole expansion property.

Sample No. 9 exhibited enlarged prior austenite grain size and enlarged average grain size of retained austenite, thus failing to obtain sufficient hole expansion property and the impact value because of high heating temperature for austenitization.

Sample No. 11 exhibited small amount of retained austenite, leading to insufficient amount of retained austenite having a grain size of 1.0 μm or more since the cooling stopping temperature is lower than a temperature in a range of 100° C. or higher and lower than 300° C. As a result, sufficient value of TS×EL and sufficient deep drawability could not be obtained.

Sample No. 15 formed ferrite during cooling, leading to excessive amount of ferrite because of low cooling rate from the rapid cooling starting temperature to the retention starting temperature ("[5] Holding Temperature" in Table 2). In addition, formation of ferrite led to insufficient formation of martensite and insufficient total amount of tempered martensite and tempered bainite. As a result, the yield ratio and the hole expansion ratio were degraded.

Sample No. 16 had precipitation of carbon as cementite since the reheating temperature is higher than a temperature in a range of 300° C. to 500° C. Therefore, the amount of retained austenite was small, and this leads to insufficient amount of retained austenite having a grain size of 1.0 μm or more. In addition, because of high reheating temperature, the fresh martensite fraction was large. As a result, TS x EL, hole expansion property, the deep drawability and the impact value were degraded.

Sample No. 17 exhibited insufficient diffusion of carbon since the reheating temperature is lower than a temperature in a range of 300° C. to 500° C. Therefore, the amount of retained austenite was small, and this leads to insufficient amount of retained austenite having a grain size of 1.0 μm or more. As a result, TS×EL and the deep drawability were degraded.

Sample No. 20 exhibited large prior austenite grain size and insufficient amount of retained austenite having a grain size of 1.0 μm or more since Ti was not added and retention was not performed at a temperature in a range of 300 to 500° C. Therefore, sufficient deep drawability and sufficient impact value could not be obtained.

Sample No. 21 exhibited large prior austenite grain and enlarged average grain size of retained austenite since Ti was not added. Therefore, sufficient hole expansion property and the impact value could not be obtained.

Sample No. 25 exhibited insufficient amount of retained austenite and insufficient amount of retained austenite having a grain size of 1.0 μm or more because of a small amount of C. As a result, sufficient TS×EL and sufficient deep drawability could not be obtained.

Sample No. 26 exhibited insufficient amount of retained austenite and insufficient amount of retained austenite having a grain size of 1.0 μm or more because of large amount of Mn. As a result, sufficient TS×EL and sufficient deep drawability could not be obtained.

Sample No. 27 exhibited excessive amount of ferrite because of a small amount of Mn. In addition, excessive amount of ferrite led to insufficient formation of martensite and insufficient total amount of tempered martensite and tempered bainite. As a result, sufficient yield ratio and hole expansion property could not be obtained.

Sample No. 28 exhibited insufficient retained austenite and insufficient amount of retained austenite having a grain size of 1.0 μm or more because of a small amount of Si+Al. As a result, TS×EL and the deep drawability were degraded.

Sample No. 29 failed to obtain sufficient SW cross tensile strength since the amount of C was excessive and retention was not performed at a temperature lower than a temperature in a range of 300 to 500° C. after austenitization.

Sample No. 30 exhibited coarsening of retained austenite because of an excessive amount of Si+Al, thus degrading expansion properties and the impact value.

The contents disclosed in the present specification include the following aspects.

Aspect 1:

A high-strength sheet containing:

C: 0.15% by mass to 0.35% by mass, a total of Si and Al: 0.5% by mass to 3.0% by mass, Mn: 1.0% by mass to 4.0% by mass, P: 0.05% by mass or less (including 0% by mass), S: 0.01% by mass or less (including 0% by mass), and Ti: 0.01% by mass to 0.2% by mass, with the balance being Fe and inevitable impurities, wherein the steel structure satisfies that:

a ferrite fraction is 5% or less, a total fraction of tempered martensite and tempered bainite is 60% or more, a retained austenite fraction is 10% or more, a fresh martensite fraction is 5% or less, retained austenite has an average grain size of 0.5 μm or less, retained austenite having a grain size of 1.0 μm or more accounts for 2% or more of the total amount of retained austenite, and a prior austenite grain size is 10 μm or less.

Aspect 2:

The high-strength sheet according to aspect 1, in which the C amount is 0.30% by mass or less.

Aspect 3:

The high-strength sheet according to aspect 1 or 2, in which the Al amount is less than 0.10% by mass.

Aspect 4:

The high-strength sheet according to any one of aspects 1 to 3, further containing one or more of Cu, Ni, Mo, Cr and B, and a total content of Cu, Ni, Mo, Cr and B is 1.0% by mass or less.

Aspect 5:

The high-strength sheet according to any one of aspects 1 to 4, further containing one or more of V, Nb, Mo, Zr and Hf, and a total content of V, Nb, Mo, Zr and Hf is 0.2% by mass or less.

Aspect 6:

The high-strength sheet according to any one of aspects 1 to 5, further containing one or more of Ca, Mg and REM, and a total content of Ca, Mg and REM is 0.01% by mass or less.

Aspect 7:

A method for manufacturing a high-strength sheet, including:

preparing a rolled material including: C: 0.15% by mass to 0.35% by mass, a total of Si and Al: 0.5% by mass to 3.0% by mass, Mn: 1.0% by mass to 4.0% by mass, P: 0.05% by mass or less (including 0% by mass), S: 0.01% by mass or less (including 0% by mass), and Ti: 0.01% by mass to 0.2% by mass, with the balance being Fe and inevitable impurities;

heating the rolled material to a temperature of an $Ac_3$ point or higher and an $Ac_3$ point+100° C. or lower to austenitize the material;

after the austenitization, cooling the material between 650° C. and 500° C. at an average cooling rate of 15° C./sec or more and less than 200° C./sec, and then retaining at a temperature in a range of 300° C. to 500° C. at a cooling rate of 10° C./sec or less for 10 seconds or more and less than 300 seconds;

after the retention, cooling the material from a temperature of 300° C. or higher to a cooling stopping temperature between 100° C. or higher and lower than 300° C. at an average cooling rate of 10° C./sec or more; and heating the material from the cooling stopping temperature to a reheating temperature in a range of 300° C. to 500° C.

Aspect 8:

The manufacturing method according to aspect 7, wherein the retention includes holding at a constant temperature in a range of 300° C. to 500° C.

The application claims priority to Japanese Patent Application No. 2017-103024 filed on May 24, 2017 Japanese Patent Application No. 2017-103024 is incorporated herein by reference.

The invention claimed is:

1. A high-strength steel sheet, comprising, in percent by mass:

C in a range of from 0.15 to 0.35%;

a total of Si and Al in a range of from 0.5 to 3.0%;

Mn in a range of from 1.0 to 4.0%;

P in a range of from 0 to 0.05%;

S in a range of from 0 to 0.01%; and

Ti in a range of from 0.01 to 0.2%, wherein, prior to processing, the sheet has an austenite grain size of 10 μm or less, wherein, in the sheet, a ferrite fraction is 5% or less, wherein, in the sheet, a total fraction of tempered martensite and tempered bainite is 60% or more, wherein the sheet has a retained austenite fraction of 10% or more, wherein the sheet has a fresh martensite fraction of 5% or less, wherein the retained austenite has an average grain size of 0.21 μm or less, and wherein the retained austenite having a grain size of 1.0 μm or more accounts for 2% or more of a total amount of retained austenite.

2. The sheet of claim 1, satisfying any one or more of (a) to (e):

(a) the C is in a range of from 0.15 to 0.30% by mass;

(b) the Al is less than 0.10% by mass;

(c) further comprising one or more of Cu, Ni, Mo, Cr, and B in a total content of 1.0% by mass or less;

(d) further comprising one or more of V, Nb, Mo, Zr, and Hf in a total content of 0.2% by mass or less; and (e) further comprising one or more of Ca, Mg, and REM in a total content of 0.01% by mass or less.

3. A method for manufacturing the high-strength steel sheet of claim 1, the method comprising:

preparing a rolled material comprising, as percent by mass: C in a range of from 0.15 to 0.35%, a total of Si and Al in a range of from 0.5 to 3.0%, Mn in a range of from 1.0 to 4.0%, P in a range of from 0 to 0.05%, S in a range of from 0 to 0.01%, Ti in a range of from 0.01 to 0.2%, and Fe;

heating the rolled material to a temperature of an $Ac_3$ point or higher and an $Ac_3$ point +100° C. or lower to austenitize the material;

after the austenitization, cooling the material between 650° C. and 500° C. at an average cooling rate in a range of from 15 to 200° C./sec, and then retaining at a temperature in a range of from 300° C. to 500° C. at a cooling rate of 10° C./sec or less for 10 seconds or more and less than 300 seconds;

after the retention, cooling the material from a temperature of 300° C. or higher to a cooling stopping temperature between 100° C. or higher and lower than 300° C. at an average cooling rate of 10° C./sec or more; and heating the material from the cooling stopping temperature to a reheating temperature in a range of from 300° C. to 500° C.

4. The method of claim 3, wherein the retaining comprises holding at a constant temperature in a range of from 300° C. to 500° C.

5. The method of claim 3, wherein the rolled material satisfies any one or more of (a) to (e):

(a) the C is in a range of from 0.15 to 0.30% by mass;

(b) the Al is less than 0.10% by mass;

(c) further comprising one or more of Cu, Ni, Mo, Cr, and B in a total content of 1.0% by mass or less;

(d) further comprising one or more of V, Nb, Mo, Zr, and Hf in a total content of 0.2% by mass or less; and (e) further comprising one or more of Ca, Mg, and REM in a total content of 0.01% by mass or less.

6. The method of claim 4, wherein the rolled material satisfies any one or more of the following (a) to (e):

(a) the C is in a range of from 0.15 to 0.30% by mass;

(b) the Al is less than 0.10% by mass;

(c) further comprising one or more of Cu, Ni, Mo, Cr, and B in a total content of 1.0% by mass or less;

(d) further comprising one or more of V, Nb, Mo, Zr, and Hf in a total content of 0.2% by mass or less; and (e) further comprising one or more of Ca, Mg and REM in a total content of 0.01% by mass or less.

7. The method of claim 3, wherein the sheet has a retained austenite has an average grain size of 0.20 μm or less.

8. The sheet of claim 1, having an amount of ferrite of 0%.

9. The sheet of claim 1, wherein the C is in a range of from 0.15 to 0.30% by mass.

10. The sheet of claim 1, wherein the Al is less than 0.10% by mass.

11. The sheet of claim 1, wherein the C is in a range of from 0.15 to 0.30% by mass, and wherein the Al is less than 0.10% by mass.

12. The sheet of claim 1, further comprising:

Cu, Ni, Mo, Cr, and/or B in a total content of 1.0% by mass or less.

13. The sheet of claim 1, further comprising:

Cu, Ni, Mo, Cr, and/or B in a total content of 1.0% by mass or less, wherein the C is in a range of from 0.15 to 0.30% by mass.

14. The sheet of claim 1, further comprising:

Cu, Ni, Mo, Cr, and/or B in a total content of 1.0% by mass or less, wherein the C is in a range of from 0.15 to 0.30% by mass, and wherein the Al is less than 0.10% by mass.

15. The sheet of claim 1, further comprising:

V, Nb, Mo, Zr, and/or Hf in a total content of 0.2% by mass or less.

16. The sheet of claim 1, further comprising:

V, Nb, Mo, Zr, and/or Hf in a total content of 0.2% by mass or less, wherein the C is in a range of from 0.15 to 0.30% by mass.

17. The sheet of claim 1, further comprising:

V, Nb, Mo, Zr, and/or Hf in a total content of 0.2% by mass or less, wherein the C is in a range of from 0.15 to 0.30% by mass, and wherein the Al is less than 0.10% by mass.

18. The sheet of claim 1, further comprising:

V, Nb, Mo, Zr, and/or Hf in a total content of 0.2% by mass or less; and

Cu, Ni, Mo, Cr, and/or B in a total content of 1.0% by mass or less.

19. The sheet of claim 1, father comprising:

V, Nb, Mo, Zr, and/or HF in a total content of 0.2% by mass or less;

Cu, Ni, Mo, Cr, and/or B in a total content of 1.0% by mass or less, wherein the C is in a range of from 0.15 to 0.30% by mass.

20. The sheet of claim 1, further comprising:

Ca, Mg, and/or REM in a total content of 0.01% by mass or less.

* * * * *